US005944477A

United States Patent [19]

Shill

[11] Patent Number: 5,944,477

[45] Date of Patent: Aug. 31, 1999

[54] BUNDLE SQUARING MACHINE

[75] Inventor: David B. Shill, Spokane, Wash.

[73] Assignee: Systematic Machinery LLC, Spokane, Wash.

[21] Appl. No.: 08/863,382

[22] Filed: May 27, 1997

[51] Int. Cl.[6] ..... B65G 47/26

[52] U.S. Cl. ..... 414/788; 414/907; 271/221; 198/345.1

[58] Field of Search ..... 414/788, 907; 271/241, 220, 221; 198/456, 345.1

[56] References Cited

U.S. PATENT DOCUMENTS

| | | | |
|---|---|---|---|
| 3,737,051 | 6/1973 | Horino | 414/788 |
| 3,750,901 | 8/1973 | Melin | 414/788 |
| 3,822,795 | 7/1974 | Salsburg et al. | 414/788 |
| 4,134,485 | 1/1979 | George | 198/456 |
| 4,178,118 | 12/1979 | Bailey | 414/788 |
| 4,181,460 | 1/1980 | Lutz | 414/788 |
| 4,203,694 | 5/1980 | James | 414/788 |
| 4,412,769 | 11/1983 | Kollmann | 414/788 |
| 4,753,564 | 6/1988 | Pearce et al. | 414/788 |
| 5,533,860 | 7/1996 | Gammerler | 414/907 |
| 5,605,215 | 2/1997 | Gross et al. | 198/456 |
| 5,785,482 | 7/1998 | Tanaka | 414/788 |

OTHER PUBLICATIONS

MOSCA brochure which shows a bundle squaring and strapping machine on sale or in public use one year prior to May 23, 1996.

*Primary Examiner*—Christopher P. Ellis
*Assistant Examiner*—Douglas Hess
*Attorney, Agent, or Firm*—Wells, St. John, Roberts, Gregory & Matkin P.S.

[57] ABSTRACT

A machine and process is described for squaring sheets stacked in a bundle supported along a plane. The bundle includes a leading bundle end, a trailing bundle end and opposed bundle sides. The machine includes a frame with a leading end stop mounted by a stop actuator mounting to position the leading end stop across the plane to engage the leading end of the bundle. A trailing end tamper is mounted to a trailing end actuator on the frame for movement to engage and urge the bundle against the leading end stop and align the sheets along the leading and trailing ends of the bundle. A pair of side plates are mounted by a side plate actuator assembly for movement to (a) engage and align sheets along the bundle sides and (b) position the bundle at a prescribed position on the plane.

19 Claims, 17 Drawing Sheets

BUNDLE SQUARING MACHINE

TECHNICAL FIELD

The present invention relates to squaring the sides and end surfaces of bundles formed of stacked semi-rigid sheets.

BACKGROUND OF THE INVENTION

Corrugated box manufacturers use "finishing" machines to form collapsed boxes from semi-rigid sheets of corrugated material. The boxes are manufactured and shipped to the end user in a knocked down (flattened) state, for later process steps by which the boxes are erected to form desired container configurations. It is typical that the boxes leaving the finishing machine are stacked in bundles. The bundles are then grouped together in stacks for shipment or storage.

In order to improve the stack quality of the bundles, it becomes desirable for the bundles to be squared, so the edges of the boxes at the leading, trailing and side surfaces of the bundle are aligned. A properly "squared" bundle thus has its end and side surfaces perfectly square with the top and bottom surfaces of the bundle. Squared bundles are easy to handle and organize into bundle stacks. However few finishing machines have the capability of forming perfectly squared bundles. Even if the finishing machine initially produces nicely squared bundles, operations downstream often result in the bundles being jostled out of square. Boxes within the bundles become slightly skewed or misaligned during handling. The side and end edges of the bundle are often not square with the top and bottom bundle surfaces.

To solve this problem, workers are sometimes stationed along the typical conveyor used to deliver bundles from the finishing machine to a stacking station. The workers attempt to manually shift the boxes within the bundles to square the bundle sides and ends before either stacking the bundles or feeding the bundles to a stacking machine. This is a tedious and time consuming task, often resulting in seriously slowing production, and adding injury risk to the workers. Yet the task must be performed because untidy bundles will not stack as fast or as well and do not produce a quality looking pallet load.

An object of the present invention is therefore to provide a machine that may be situated downstream of a finishing machine and along a bundle conveyor to square successive bundles.

A further object of the present invention is to provide such a machine that will center bundles on the conveyor.

A still further object of the present invention is to provide such a machine that may be operated rapidly enough so as not to slow down the finishing machine production.

BRIEF DESCRIPTION OF THE DRAWINGS

Preferred embodiments of the invention are described below with reference to the following accompanying drawings.

FIG. 6 is an enlarged detail view of a side plate and tamper arm as seen from substantially along line 6—6 in FIG. 10;

FIG. 7 is an enlarged sectional view taken substantially along line 7—7 in FIG. 10;

FIGS. 11 and 12 are exaggerated operational views illustrating angular deflection of a side plate upon engagement with a bundle side;

FIG. 13 is a fragmented top sectional view illustrating placement of a bundle coming photo eye;

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
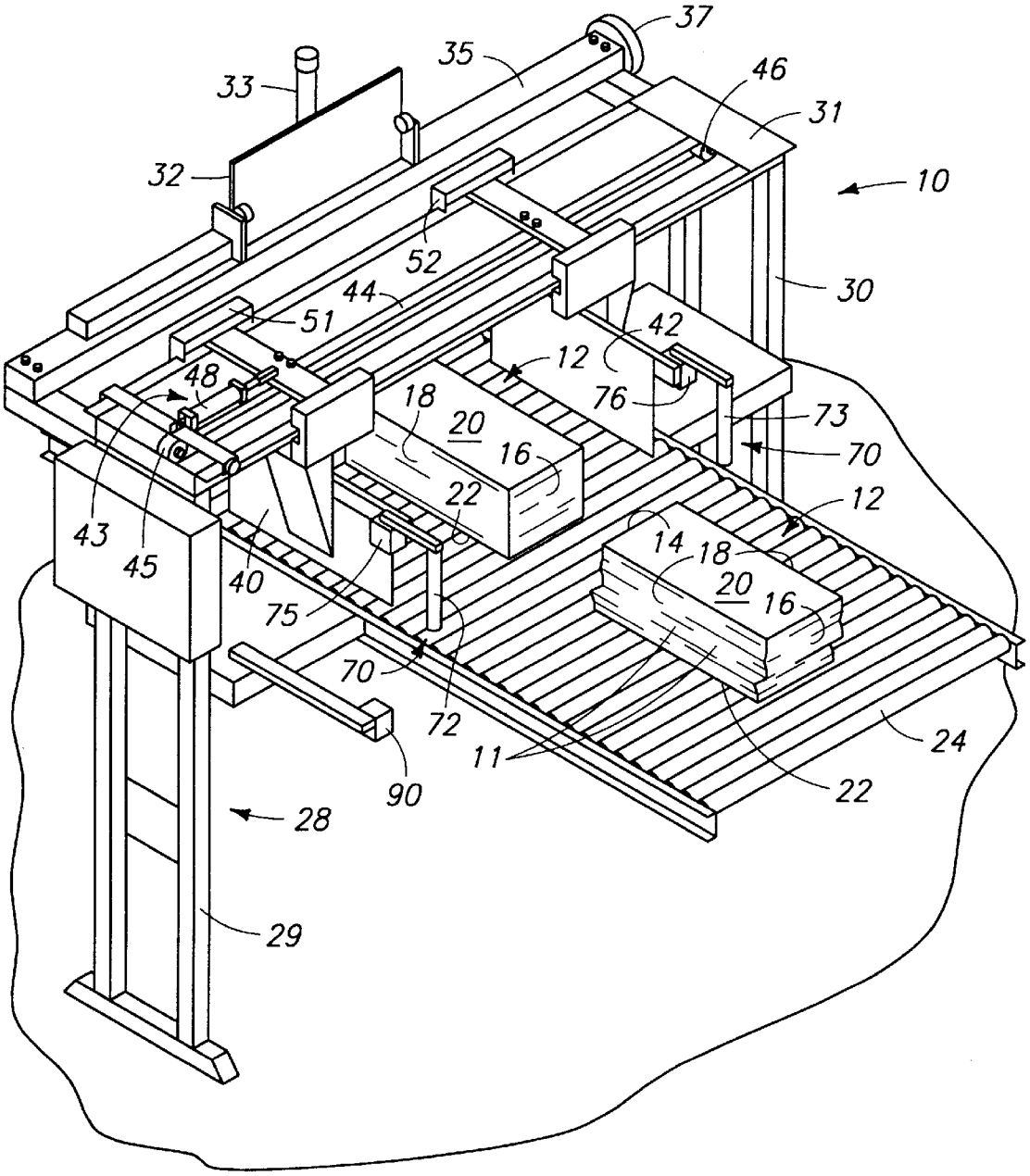
FIG. 1 is a perspective diagrammatic view of a preferred form of the present bundle squaring machine.

A preferred form of the present machine is generally referred to in the drawings by the reference numeral 10. The preferred machine is operable to square semi-rigid sheets 11 (FIG. 1) stacked in a bundle 12 that is supported along a plane X.

The bundle 12, for purposes of further description is formed as a stack of semi-rigid sheet materials such as flat boxes fed from a conventional finishing machine (not shown). The bundle includes a leading bundle end 14, a trailing bundle end 16 and opposed bundle sides 18. The bundle also includes respective top and bottom surfaces 20, 22.

Figure 11:
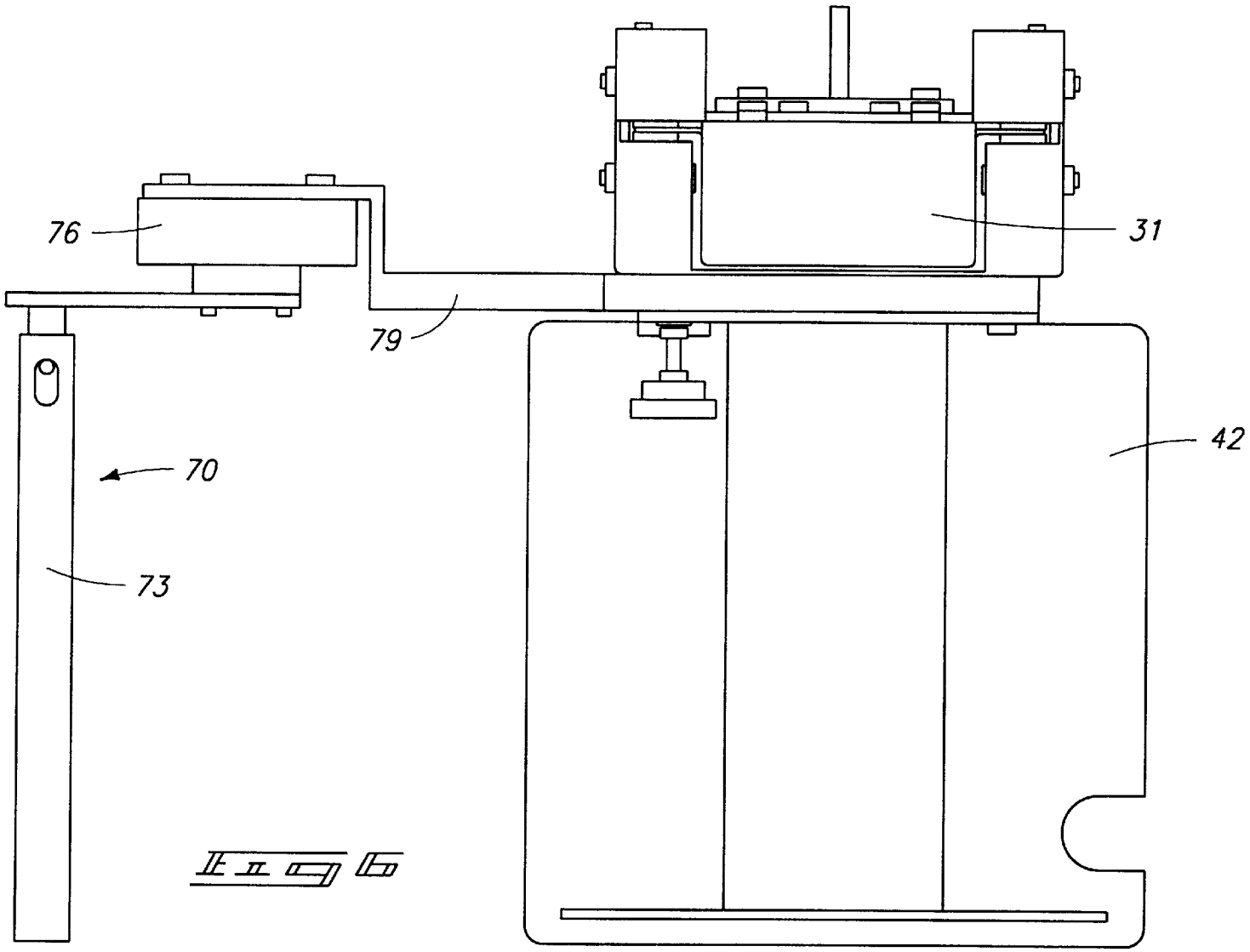
Figure 11:
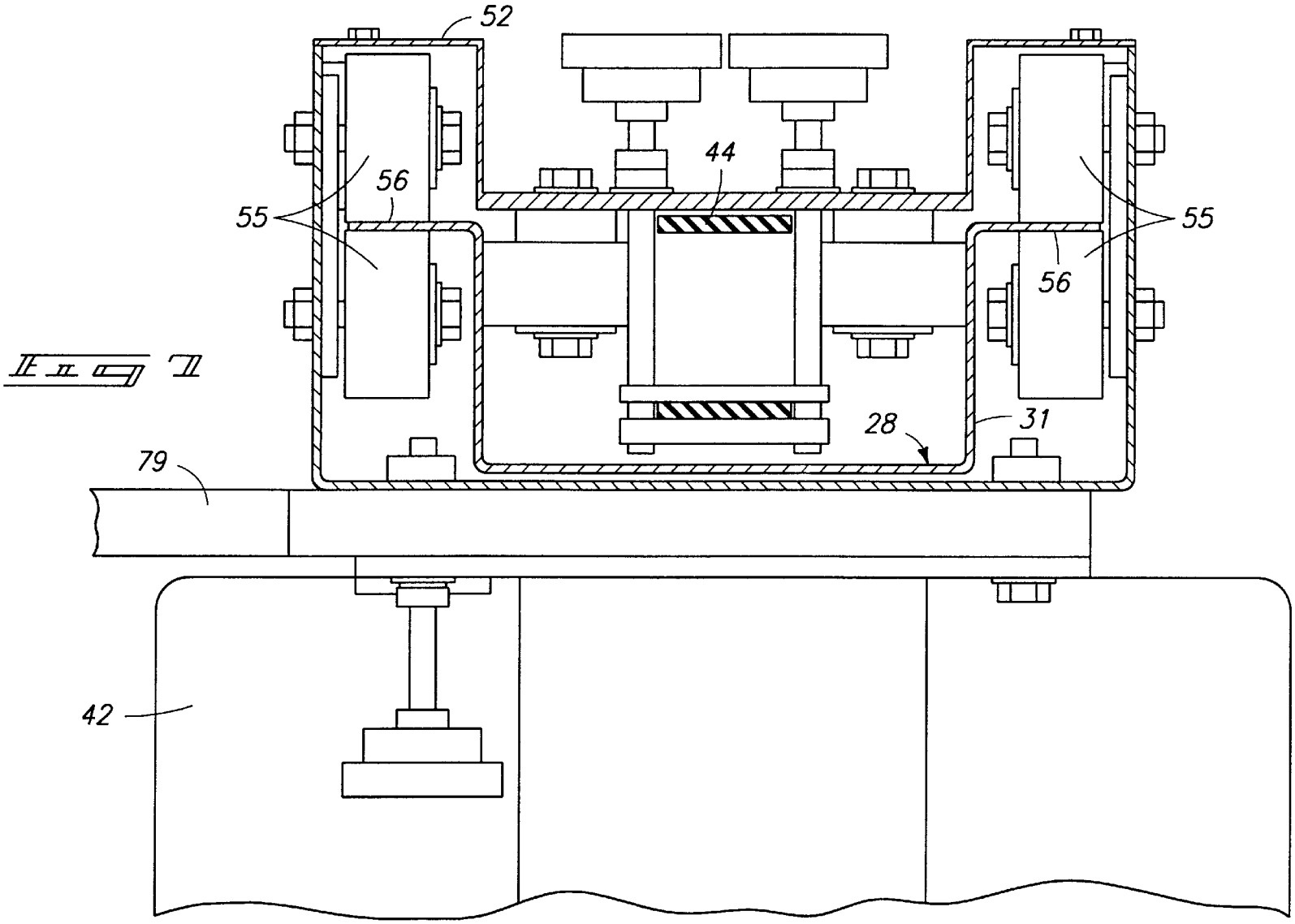

For purposes of illustration, a partial bundle is shown in FIGS. 11 and 12 in which individual semi-rigid sheets 11 are shown stacked one on another. The sheets 11 forming the bundles are loose and may be initially stacked in disarray and out of alignment to the right in FIG. 3. In contrast, the sheets 11 are shown in a squared bundle to the left in FIG. 3 where the edges of the sheets have been aligned with one another. The present machine 10 is used to square successive bundles delivered along a feed conveyor 24 to the condition shown to the left in FIG. 3.

Figure 2:
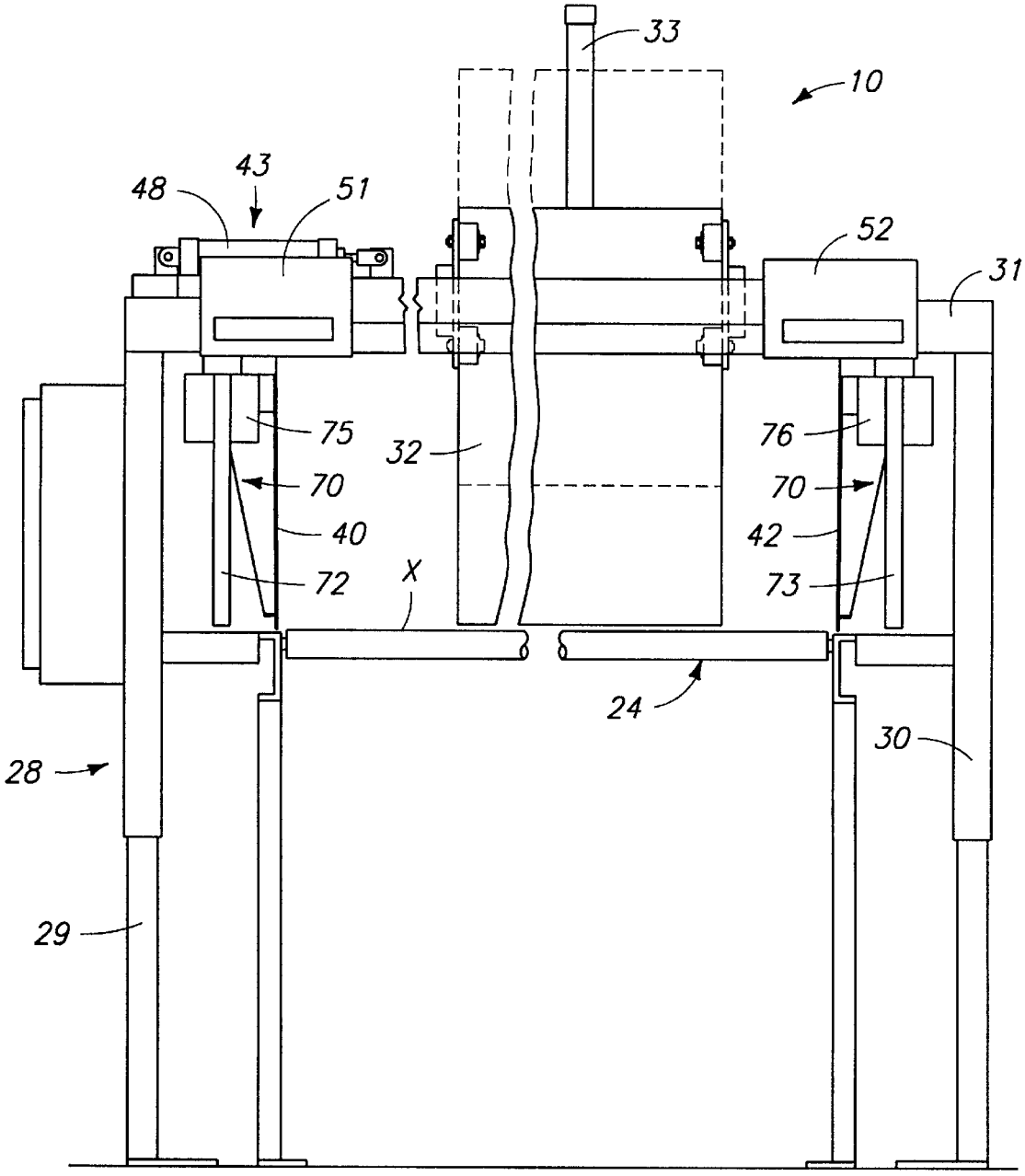
FIG. 2 is a fragmented upstream end view of the preferred bundle squaring machine.

The plane X (FIG. 2) may be defined by the working flight of the feed conveyor 24, which may be supplied as part of the present machine 10. More preferably however, the conveyor 24 is an existing roller-type conveyor that is in place and operational. Thus, the present machine 10 may be supplied to operate in conjunction with the conveyor 24 along its existing working flight. In either instance, the conveyor 24 is preferred to be a conventional powered roller conveyor provided to transport bundles along the plane X, typically in single file and in a forward direction to the present machine 10, where the successive bundles are squared. The conveyor 24 also leads outwardly from the machine 10, carrying the squared bundles onwardly for further processing.

The present machine includes a frame 28 that, in a preferred form, is configured to straddle the conveyor 24 transversely to the conveyor length. It is preferred that the frame 28 be rigid but adjustable using conventional leveling devices (not shown) so the components described below will function without requiring special alterations of the conveyor 24.

The preferred frame 28 thus includes a pair of opposed upright leg members 29, 30, and a horizontal hat section 31 that rests atop the leg members and bridges the conveyor in a transverse manner. The components described below are mounted to the frame directly or indirectly for operation relative to the conveyor 24 and the plane X.

Figure 4:
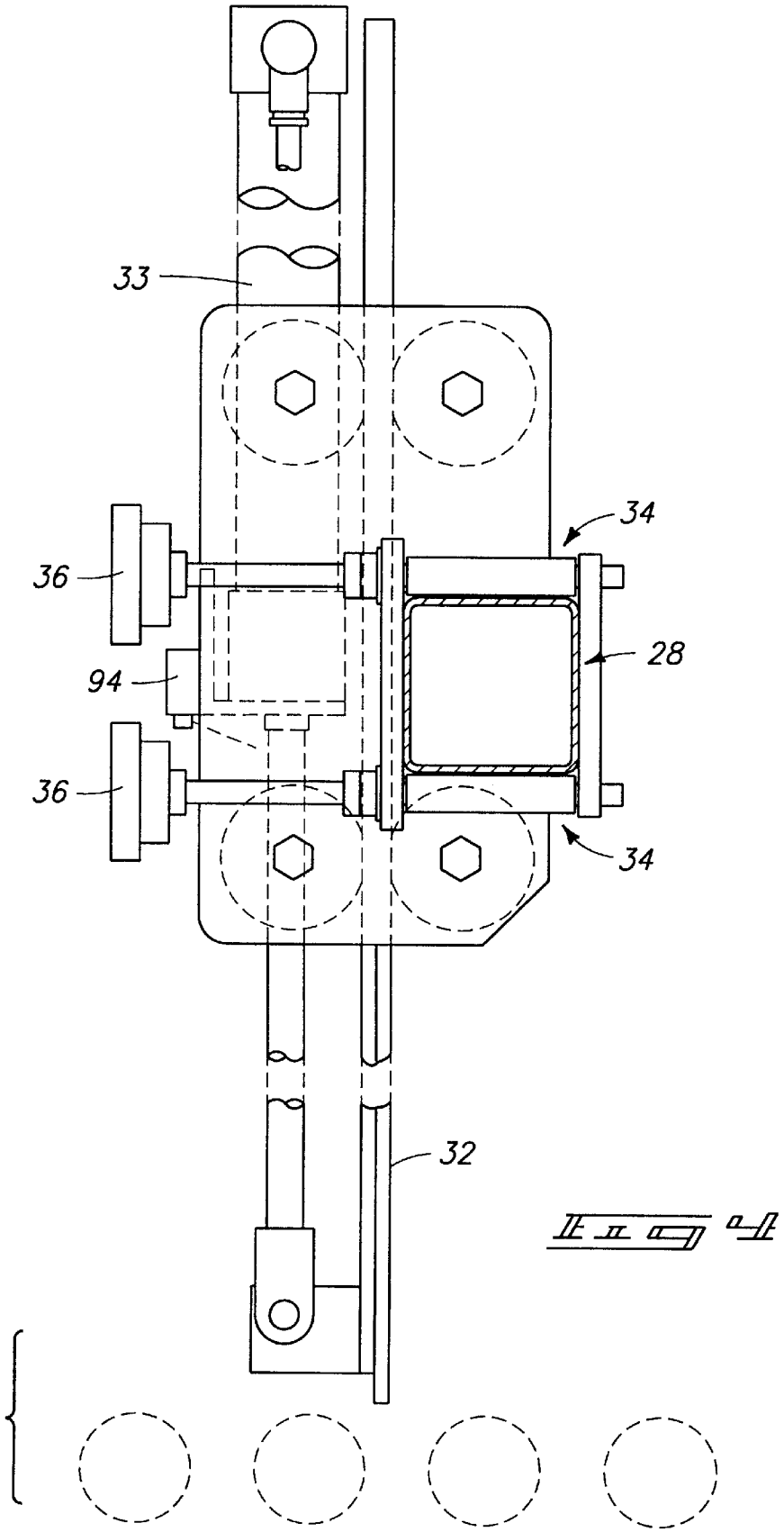
FIG. 4 is an enlarged fragmented sectional detail view of a leading end bundle stop and actuator.
Figure 5:
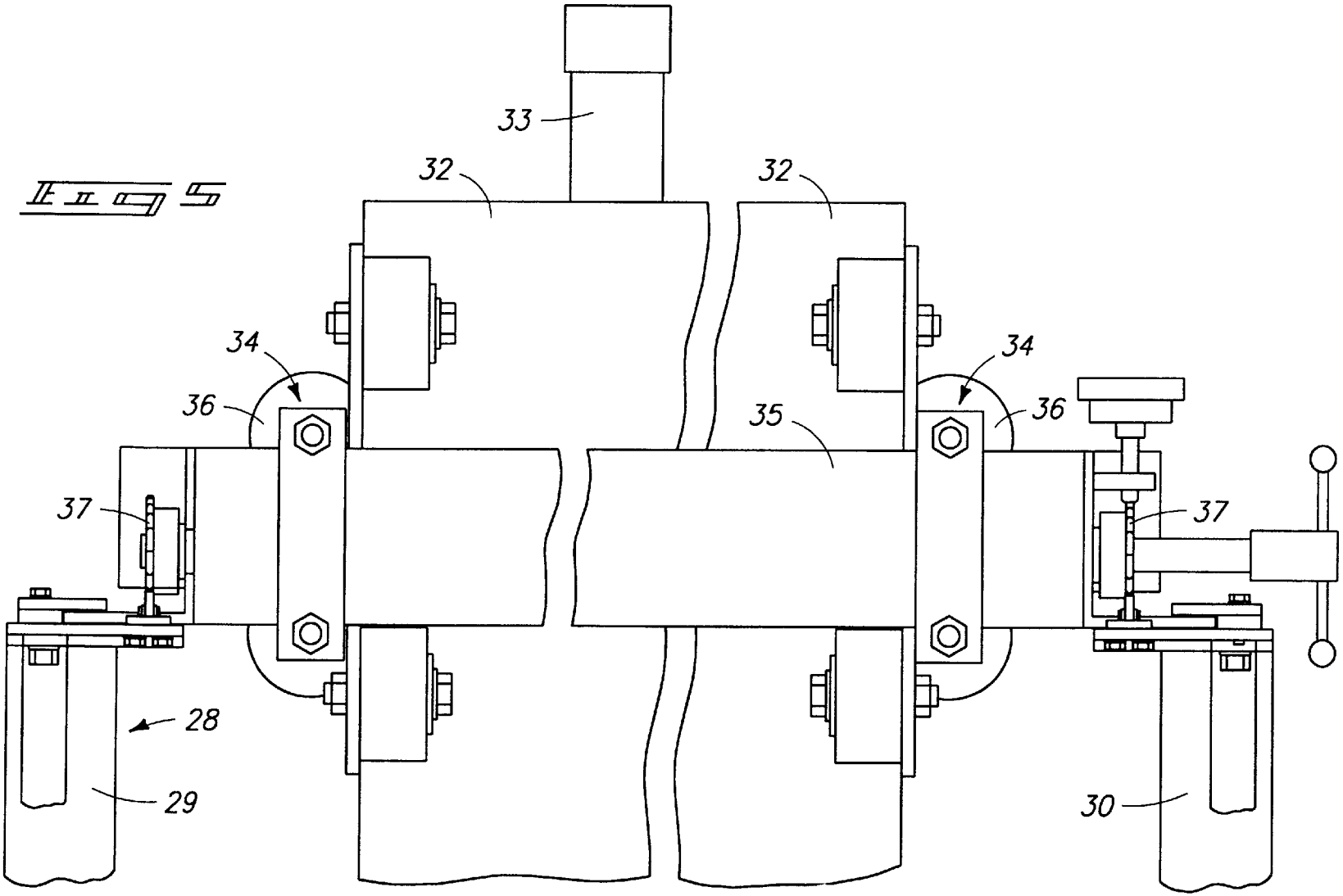
FIG. 5 is an enlarged fragmented sectional detail view of the leading end bundle stop and actuator taken substantially along line 5—5 in FIG. 3.

A leading bundle end stop 32 (FIGS. 2, 4 and 5) is mounted to the frame 28 along the hat section 31. The stop 32 is comprised of a rigid plate mounted to the hat section 31 of the frame 28 for substantially vertical motion. The preferred stop 32 is oriented across (substantially perpendicular) to the plane X and moves between a down position (solid lines in FIG. 2) to intercept and abut a bundle moving on the conveyor 24, and an up position (dashed lines in FIG. 2) clear of the bundle to allow the bundle to move onward following the squaring operation described below.

A leading end stop actuator 33 mounts the leading bundle end stop 32 to the frame and is operable to position the stop 32 across the plane X to engage the leading end 14 of the bundle. In a preferred form, the stop actuator 33 is a powered ram cylinder selectively driven by pressurized fluid. The leading end stop actuator 33 is mounted between the frame and bundle leading end stop 32 such that extension of the cylinder move the stop 32 to the down position, and retraction of the cylinder will move the stop 32 to the up position. It is preferred that such movement, as shown in the drawings, occur in a substantially vertical plane. As an alternative, the stop 32 and stop actuator 33 could be configured so the stop is movable horizontally across the conveyor.

The preferred leading bundle end stop 32 and stop actuator 33 are adjustably mounted by stop adjustment assemblies 34 (FIG. 4) that are selectively operable to secure the stop actuator at a selected lateral position in relation to the conveyor below. The stop adjustment assemblies 34 are slidably mounted to an appropriate horizontal cross member 35 carried on the frame, and are selectively locked in position along the member 35 by clamping forces applied through hand screws 36.

Longitudinal adjustment of the bundle end stop position along the conveyor may be provided for by a preferred rack and pinion (or chain and sprocket) mounting arrangement 37 (FIG. 5) which movably mounts the end stop 32, stop actuator 33, adjustment assemblies 34, and cross member 35 along the frame 28. Longitudinal positioning of these components in relation to side plates 40, 42 (described below) is provided to accommodate the length of bundles and to select the location at which the bundles are to be stopped in relation to the remaining components of the machine. Preferably, the rack or chain is secured to the frame 28, parallel to and above the plane X. The pinion or sprockets are rotatably mounted to the cross member 35. Manual or powered rotation of the pinion or sprockets results in corresponding movement of the end stop components along and over the conveyor.

A pair of side plates 40, 42 are positioned independently of the end stop assembly above the conveyor and upstream of the leading bundle end stop 32. The side plates are provided to engage the opposed bundle sides 18 and square the sides with the bundle top and bottom surfaces 20, 22.

The side plates 40, 42 face one another laterally across the conveyor 24. At least one and preferably both of the side plates 40, 42 move laterally (with respect to movement of the bundles on the conveyor 24) toward and away from one another.

A preferred side plate actuator assembly 43 mounts the side plates 40, 42 to the frame for movement between open and closed positions. During such movement, the side plates 40, 42 engage and align sheets 11 along the bundle sides 18 and position the bundle 12 at a prescribed position on the plane X.

As shown in FIGS. 1, 3, 9 and 10, the actuator assembly includes a belt 44 trained about opposed pulleys 45, 46 mounted at opposite ends of the frame hat section 31. The pulleys 45, 46 are mounted for rotation about laterally spaced horizontal axes to the frame hat section 31.

The belt 44 includes vertically spaced horizontal flights which will move in opposed lateral directions as the belt is powered to move about the pulleys 45, 46. Such movement is preferably effected by a ram cylinder 48, which is included as a component of the side plate actuator assembly. The cylinder 48 may be selected from conventional varieties driven by pressurized fluid. Desired movement of the belt 44 could also be effected by other drive sources such as an electric, hydraulic or pneumatic linear actuators, motors, or other appropriate reciprocating drives.

Figure 8:
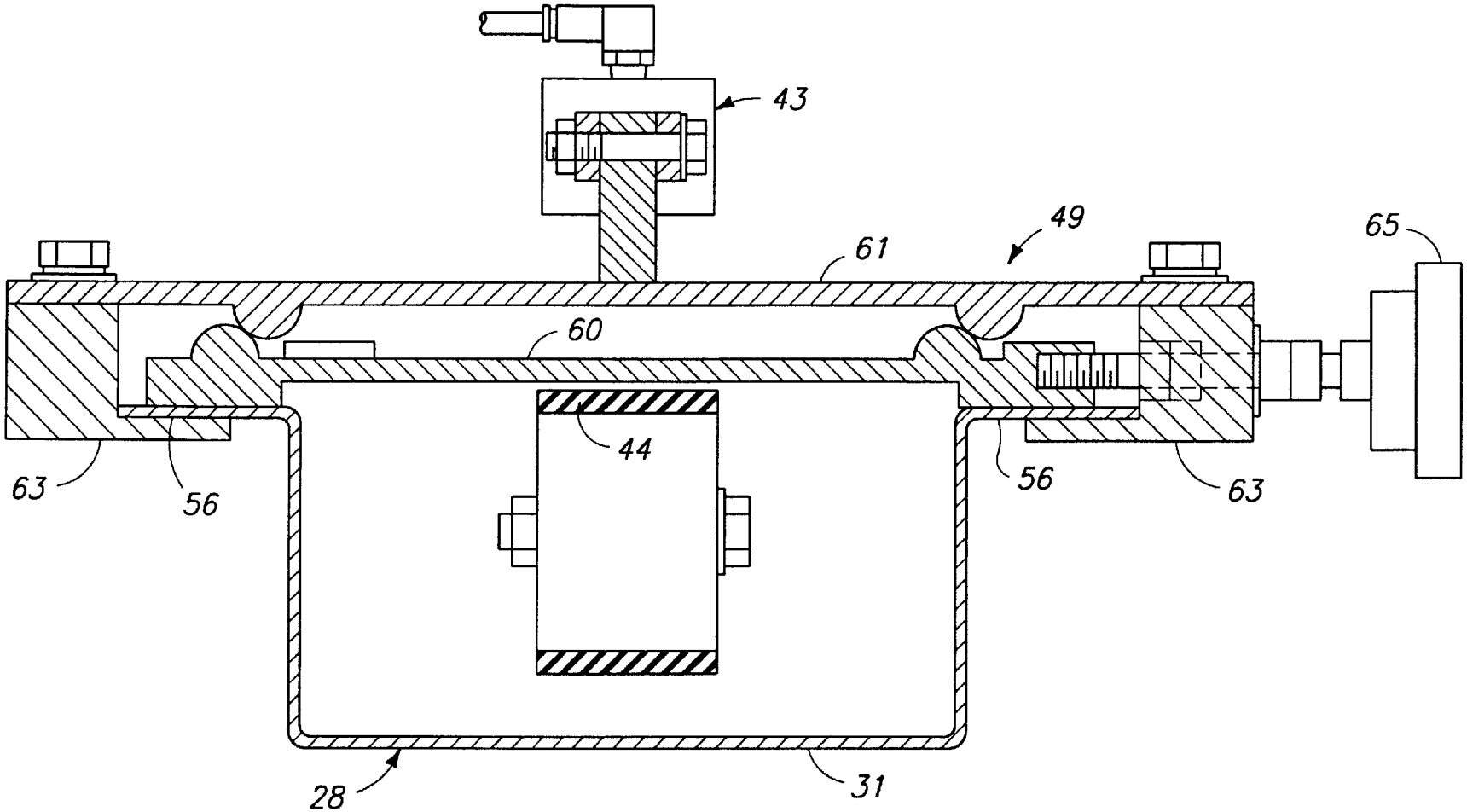
FIG. 8 is an enlarged sectional view taken substantially along line 8—8 in FIG. 9.
Figure 9:
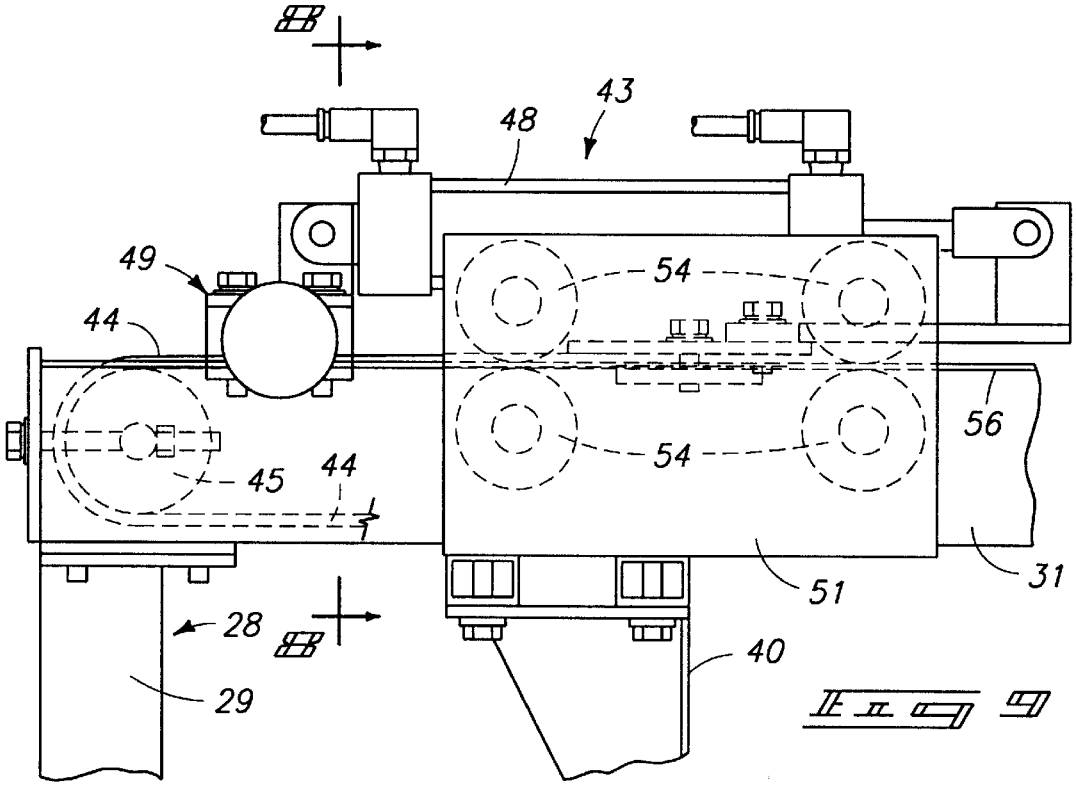
FIG. 9 is an enlarged fragmented detail view of the left side plate and carriage viewed from upstream as in FIG. 2.
Figure 10:
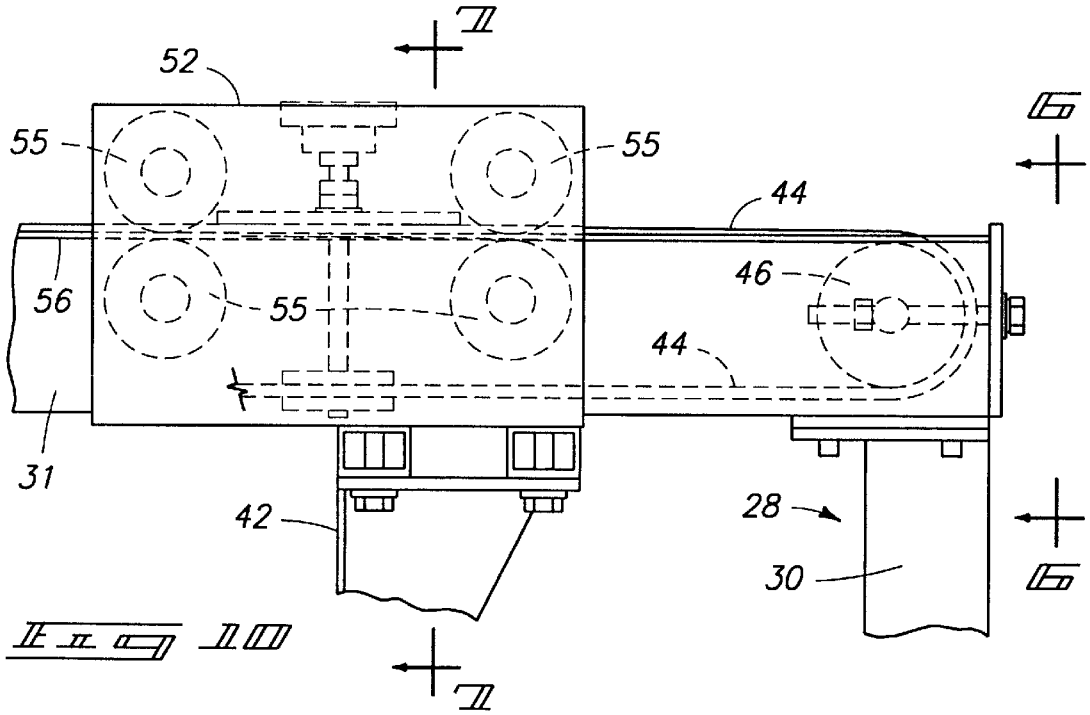
FIG. 10 is an enlarged fragmented detail view of the right side plate and carriage viewed from upstream as in FIG. 2.
Figure 11:
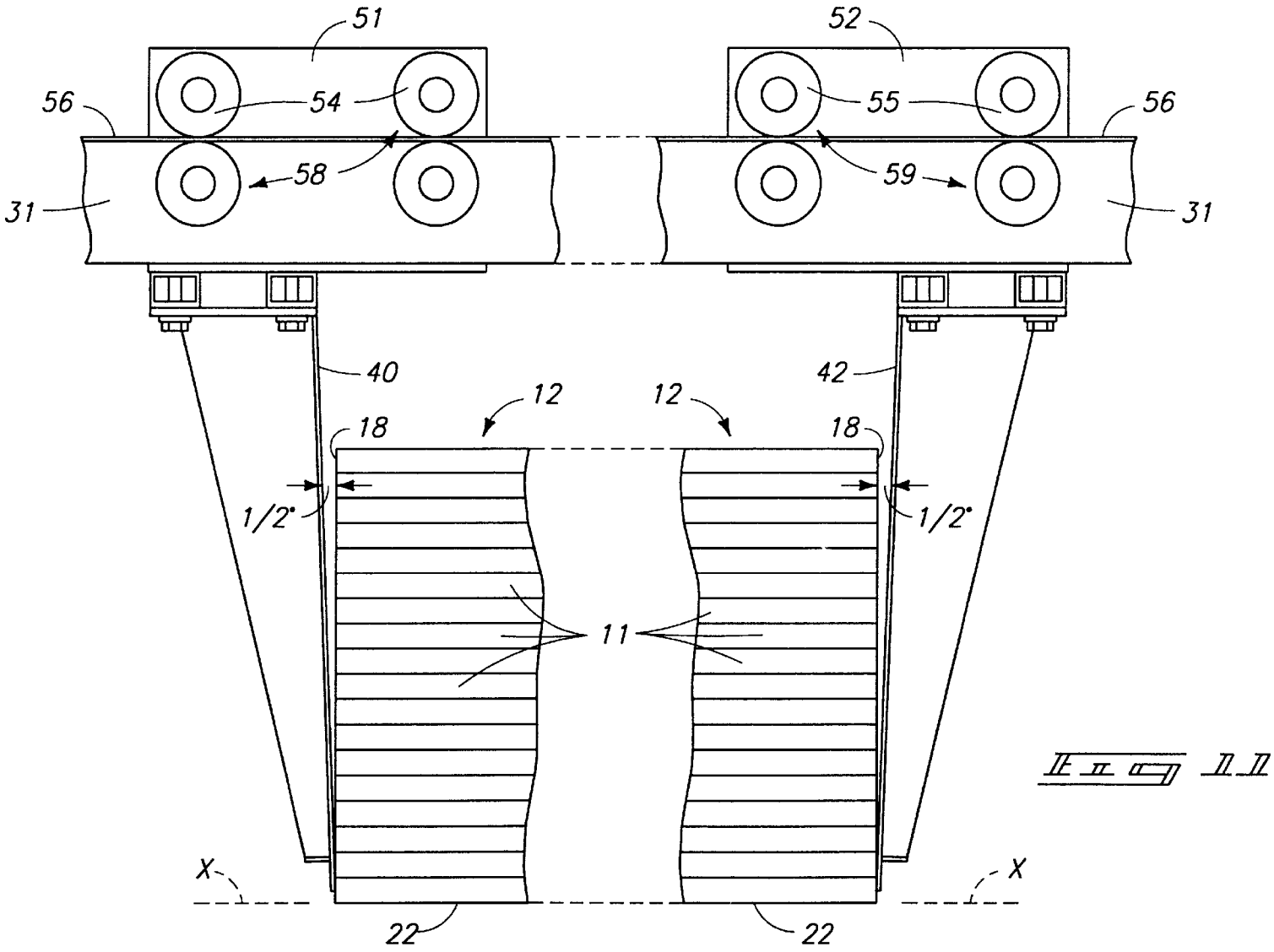
Figure 11:
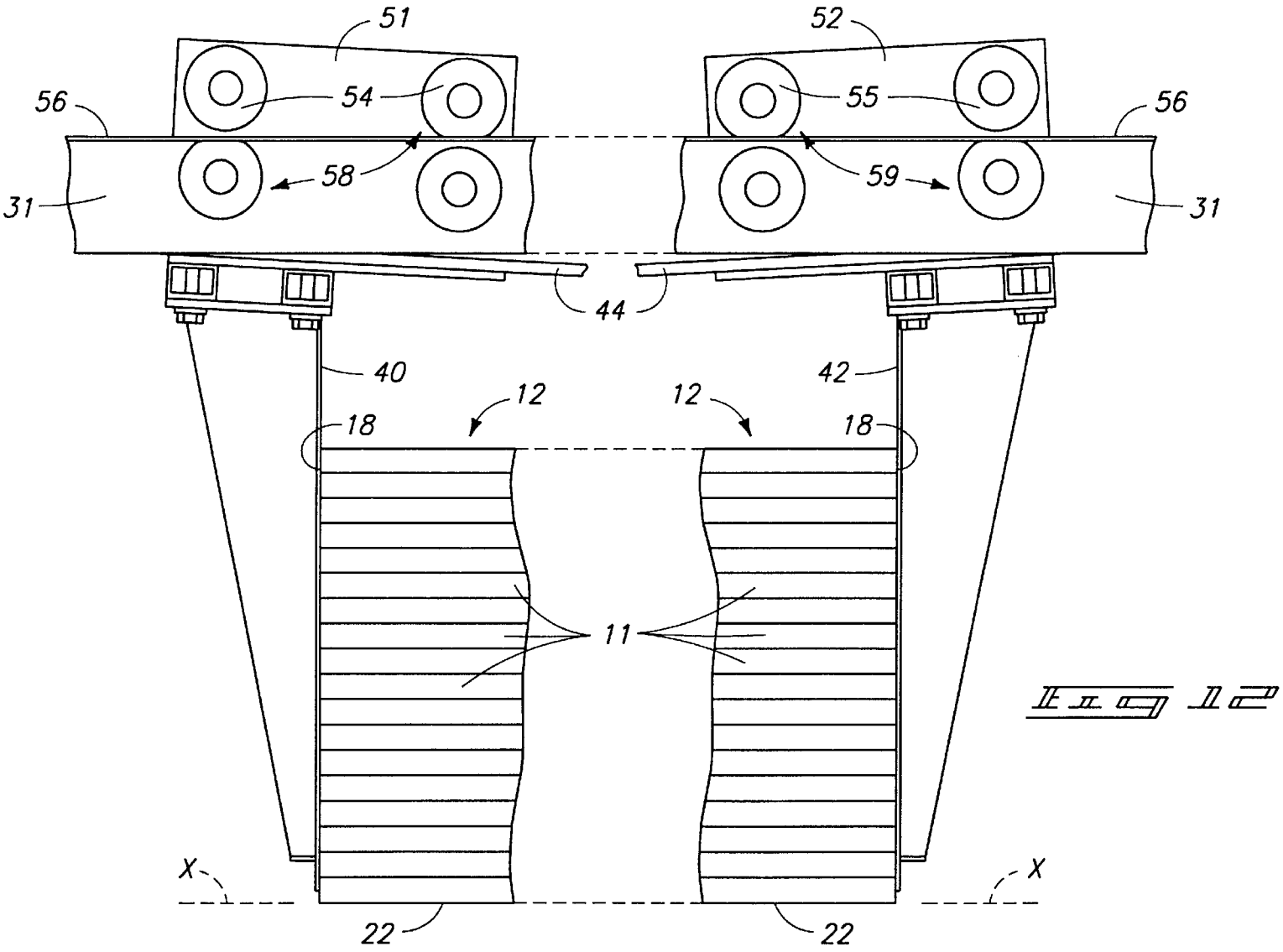
Figure 11:
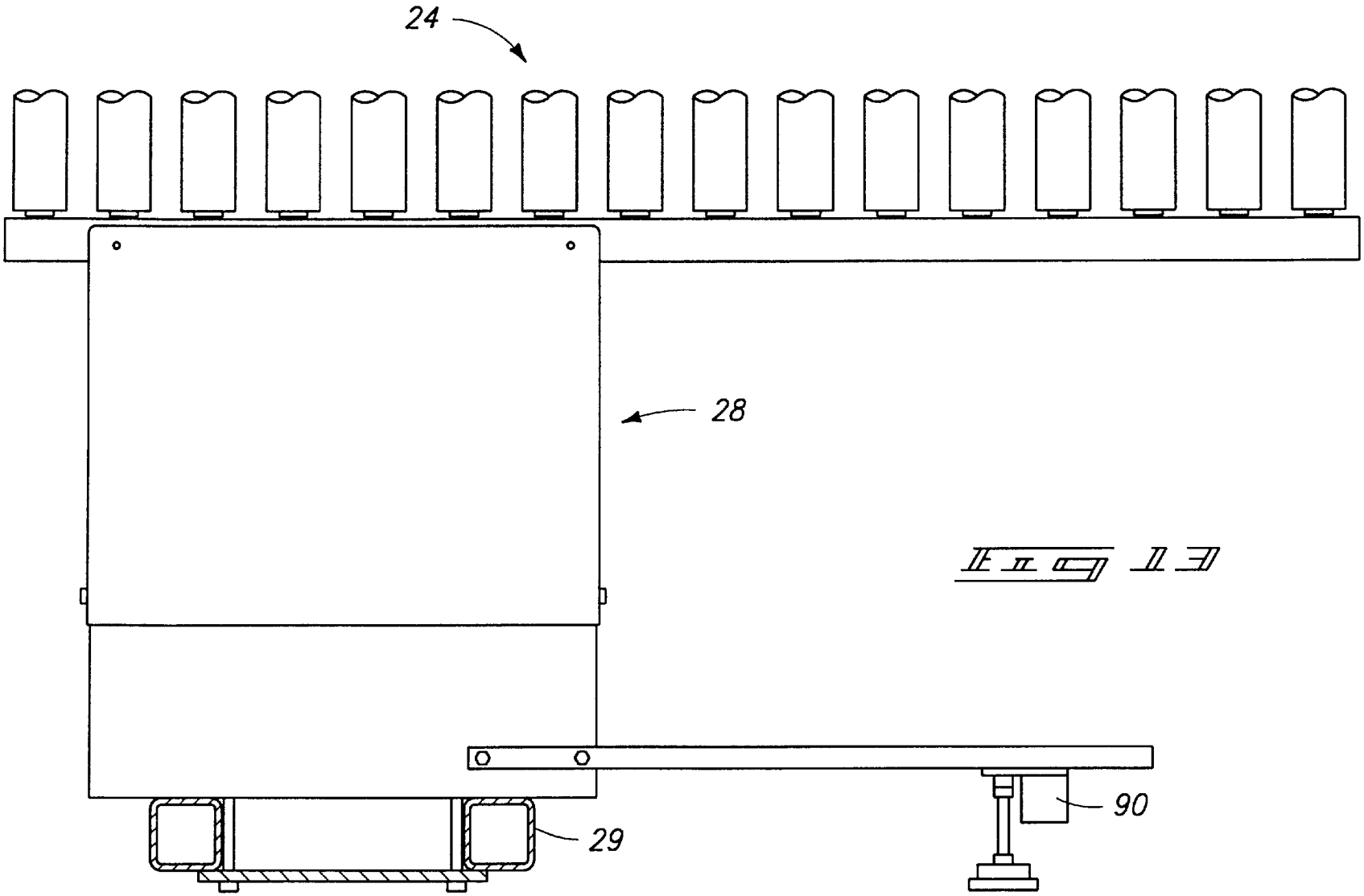

One end of the cylinder 48 is connected to the frame hat section 31 by way of an adjustment carriage 49 (FIG. 8). The other end of the cylinder is connected to the upper flight of the belt 44. The adjustment carriage 49 may be selectively locked to the stationary frame hat section 31, so the cylinder 48, upon extension and retraction, will move the upper flight of the belt back and forwardly. Of course the lower flight of the belt 44 will also move, but in opposite directions to that of the upper flight.

One of the side plates 40 is mounted to the upper flight of the belt, while the other side plate 42 is mounted to the lower flight of the belt. Thus extension and retraction of the cylinder 48 will result in opposed lateral movement of the side plates, toward and away from one another.

The side plates 40, 42 are mounted to respective side plate carriages 51 (FIG. 9) and 52 (FIG. 10) that are mounted by roller sets 54, 55 to a rigid transverse track 56. One carriage 51 is selectively clamped to the top flight of the belt 44, while the other carriage 52 is selectively clamped to the lower flight. Either of the side plate carriages 51, 52 may be selectively released and repositioned along the associated belt flight to facilitate initial set up or desired lateral side plate location in relation to the conveyor 24. However, primary lateral adjustment of the side plate separation is effected by the adjustment carriage 49 (described in greater detail below) which enables both side plates to be laterally adjusted simultaneously.

Figure 21:
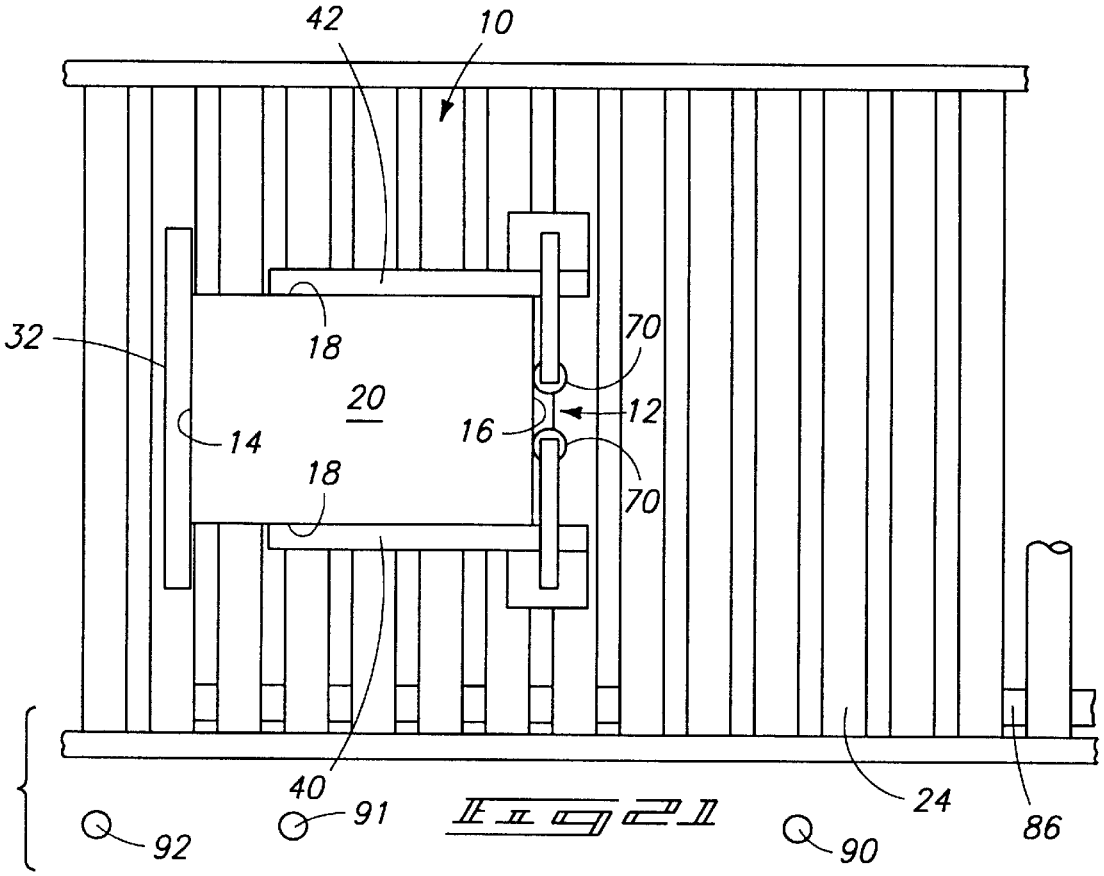
Figure 22:
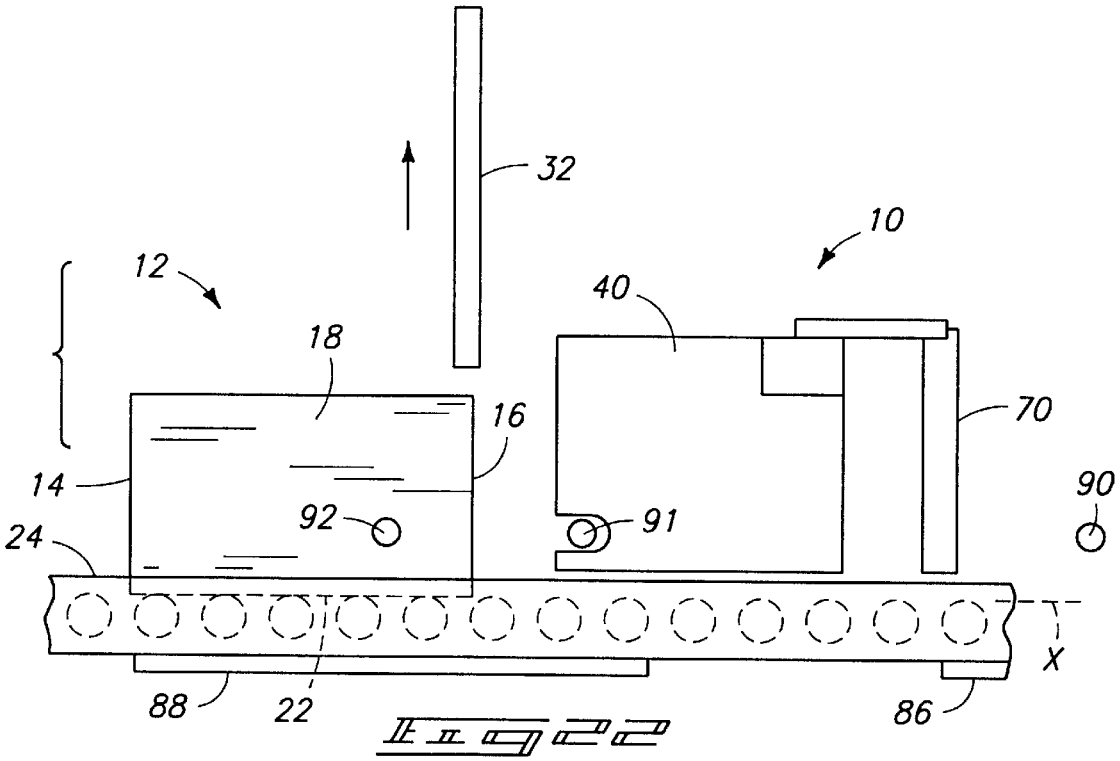

Spacing between the side plates 40, 42 is such that upon full extension of the cylinder 48, the plates will be spaced apart by a distance equal to or slightly less than the width of the bundle between the bundle sides 18 (FIG. 21). Upon full retraction of cylinder 48 (FIG. 1), the plates 40, 42 will be separated by a distance wider than the bundle width. The separation distance is determined by the cylinder stroke length.

It is noted in FIGS. 11 and 12 that one or both of the side plates are normally held at angles slightly off the vertical (preferably at opposed angles of approximately ½° from a vertical plane), so that their opposed planar surfaces converge toward the plane X. This angle is shown exaggerated in FIG. 11 for illustrative purposes. This is done SO that when the side plates are moved together against a bundle, the bottom sheets 11 in the bundle will be the first to be engaged by the side plates. Then as cylinder continues to extend to the full stroke, the plates will continue to move together. The resistance offered by the engaged bundle will cause the side plates to shift angularly (FIG. 12) to parallel vertical planes, which occurs as the cylinder 48 reaches full extension. The angularly shifting plates will thus progressively engage sheets along the bundle sides, squaring the sides in a bottom-to-top progressive manner.

Such angular movement of the side plates 40, 42 is provided in a preferred form through an angle controller 58, which yieldably positions the side plates at the initial desired converging angles. The angle controller then allows the side plates to shift to substantially parallel positions normal to the plane X in response to operation of the side plate actuator assembly 43.

The preferred angle controller 58, 59 includes the roller sets 54, 55 which are formed of an appropriate resilient material such as real or synthetic rubber. The resilient rollers are positioned on the side plate carriages and bear the weight of the carriages 51, 52 and side plates 40, 42 in such a manner that the side plates will normally converge at the selected converging angles (FIG. 11). However, when the cylinder is extended and the side plate actuator assembly 43 is operated to move the side plates together against the bundle sides, some of the rollers will bind and compress against the track 56. This action is shown exaggerated in FIG. 12 to visually illustrate the angular deviation and deflection of the rollers.

The resilient rollers act as compression springs, yieldably resisting yet allowing angular movement of the side plates 40, 42 to the vertical positions. When the cylinder is retracted and the side plates are moved back apart, the partially flattened rollers will return to their normal circular shape and shift the side plates back to their original angularly converging positions.

Returning to the adjustment carriage 49 briefly described above, attention is drawn to FIG. 8. Here a preferred form of the carriage 49 is shown including paired half-cylindrical rails on a first clamp member 60 movably carried inside the carriage 49. The clamp member 60 slidably engages the hat section 31 along the tracks 56. The rails of clamp member 60 are parallel to one another and to the tracks 56. Opposed pairs of half-cylindrical rails 61 on a second clamp member 61 slidably engage the rails on the first clamp member 60 and are affixed to the adjustment carriage 49 (which also mounts one end of the cylinder 48). The carriage 49 is also slidably secured to the hat section by flanged lugs 63 which slidably engage the opposed tracks 56 on the frame hat section 31.

A hand screw 65 extends through one of the flanged lugs 63, and threadably engages the clamp member 60. The hand screw 65 may be manually turned to tighten and lock the carriage 49 to the frame hat section by pulling the rails of the first clamp member 60 against the rails of the second clamp member 61. The cylindrical surfaces of the rails cam against one another, forcing the clamp member 60 downwardly against the hat section tracks 56. At the same time, the flanged lugs 63 are lifted with the carriage 49 and clamp firmly against the undersides of the hat section tracks 56. The carriage is thus firmly secured to the hat section of the frame.

When the hand screw 65 is turned the opposite direction, the clamping force is relaxed and the carriage is freed to move along the tracks 56. Since one end of the cylinder 48 is mounted to the carriage 49 and the other cylinder end is mounted to the belt, the side plates 40, 42 (being mounted to the upper and lower flights of the belt 44) will correspondingly move together or apart. The operator is thus allowed to selectively adjust the spacing between the side plates 40, 42 to accommodate bundles of varying width.

It may be understood from the above that two independent adjustments of the side plates are made possible by: 1) selectively clamping the side plate carriages 51, 52 at desired positions along the upper and lower flights of the belt 44 to initially position the side plates over the conveyor, and 2) using the adjustment carriage 49 to set the spacing between the side plates.

A trailing end tamper 70 is operably mounted to the frame for motion to engage the trailing end 16 of a bundle that has moved into abutment with the bundle leading end stop 32. Preferably the trailing end tamper 70 is comprised of weighted tamper arms 72, 73 mounted to the side plate actuator assembly 43. Most preferably, the pivoted tamper arms 72, 73 are mounted to the respective side plates 40, 42 for pivotal movement about tamper arm axes that are parallel and substantially normal to the plane X.

Trailing end tamper actuators 75, 76 in the form of conventional rotary actuators, mount the trailing end tampers for movement to engage and urge the bundle forwardly against the leading end stop and align the sheets along the leading and trailing ends of the bundle. The actuators are operable to swing the tamper arms 72, 73 about the tamper arm axes through arcs beginning at starting points adjacent the side plates 40, 42, to ending points between the side plates. The inclusive angles between the starting and ending points may vary, but will typically be approximately 90°.

The tamper arms 72, 73 are weighted so they will forcibly impact and drive the trailing ends of sheets in a bundle forwardly against the bundle leading end stop 32. The tamper arms are covered with an appropriate resilient padding to avoid damage to the impacted sheets.

The trailing end tamper actuators 75, 76 may be adjusted upstream or downstream to accommodate bundles of varying length (between leading end 14 and trailing end 16). To accomplish such adjustment, the actuators 75, 76 and tamper arms 72, 73 are mounted at ends of slide bars 78, 79. The slide bars 78, 79 are slidably mounted to the respective side plates 40, 42 for longitudinal adjustment with respect to the conveyor 24.

It is pointed out that since the trailing end tampers are mounted to the side plates 40, 42, movement of the side plates laterally across the bundle conveyor 24 will result in similar lateral movement of the tamper arms. The operational sequence (described below) is such that the side plate actuator will initiate inward movement of the side plates as the trailing end tamper actuators are in operation.

All components of the present machine 10, other than those described as manually operable, are powered using conventional electrical and fluid drive mechanisms well known in the art. The various drive mechanisms are selectively controlled using conventional control mechanisms, selected from appropriate commercially available sensors, sequencer, switching and control devices.

Figure 3:
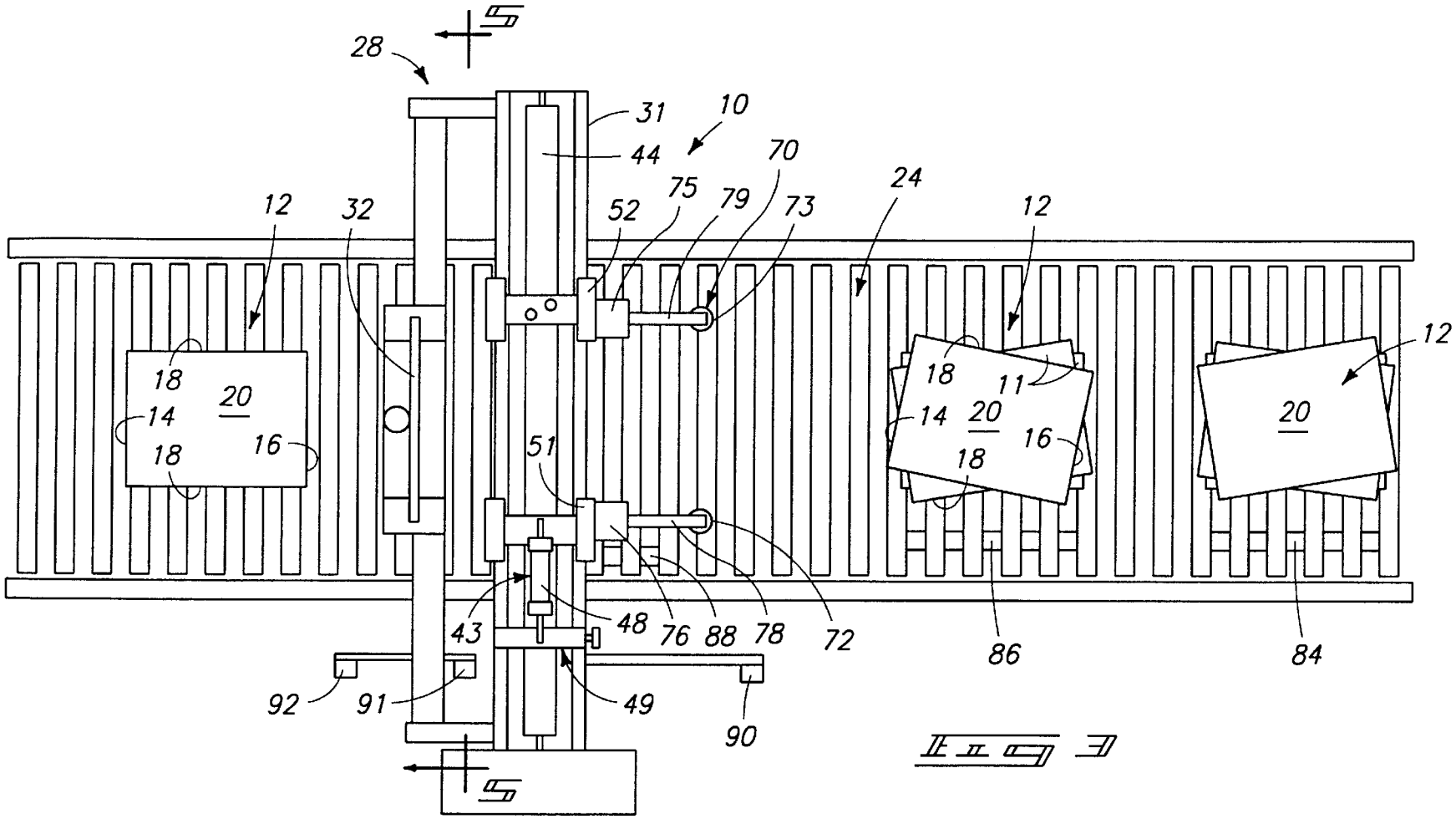
FIG. 3 is a top plan view thereof.
Figure 14:
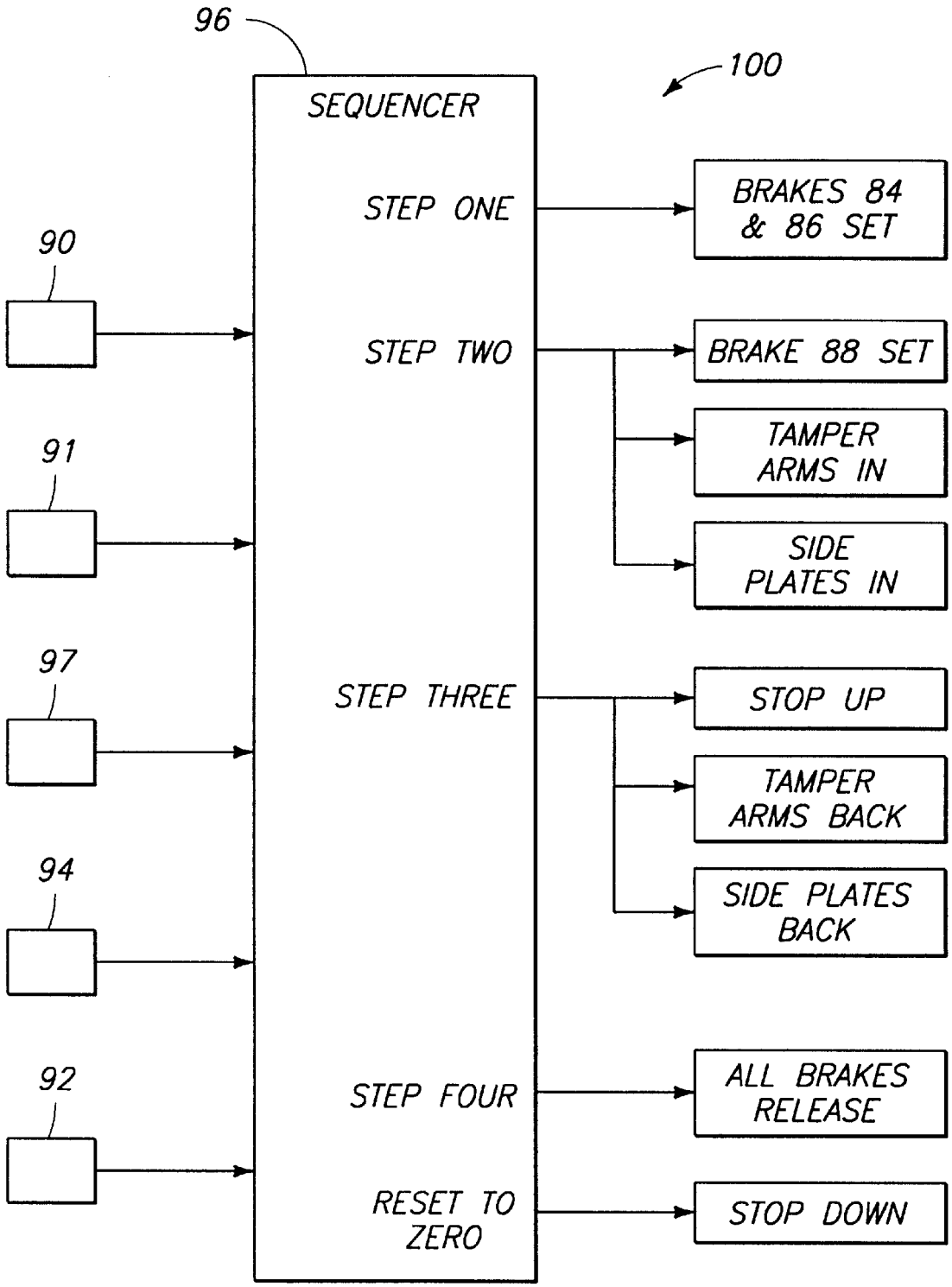
FIG. 14 is a control diagram.
Figure 15:
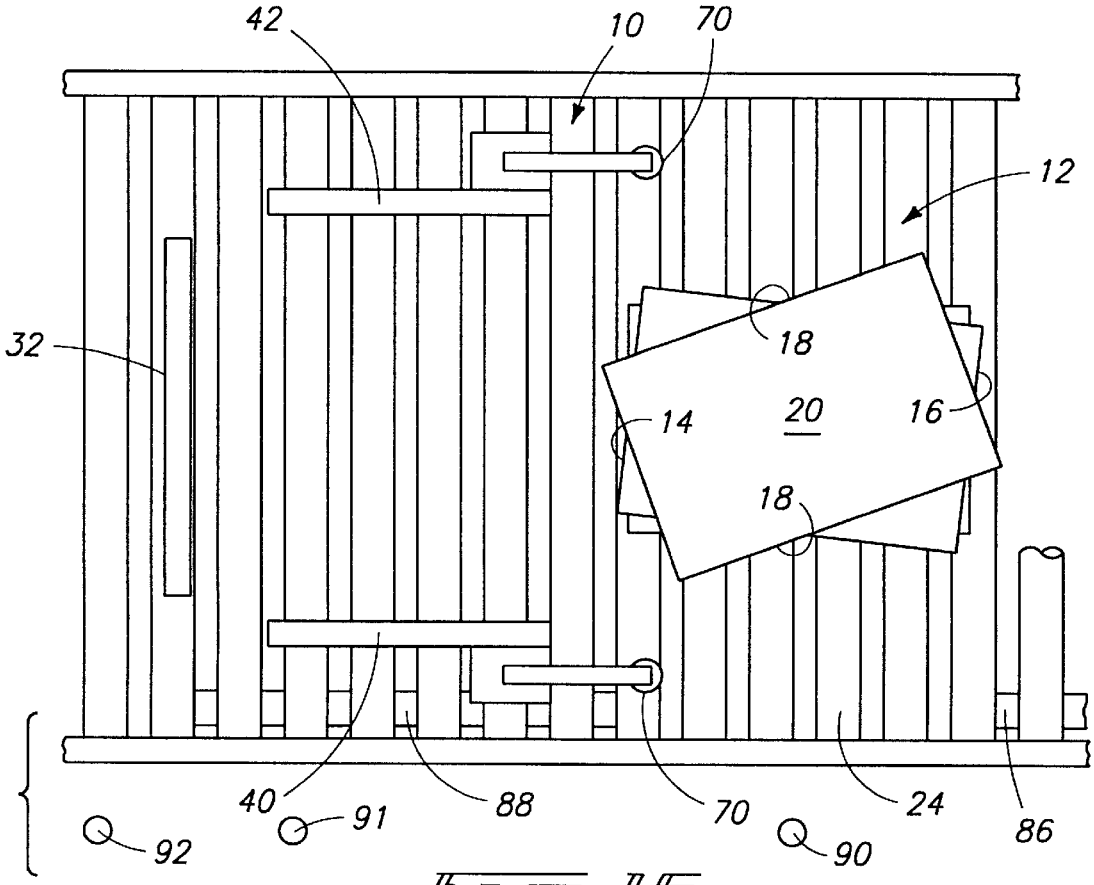
FIGS. 15–22 are schematic operational views.
Figure 16:
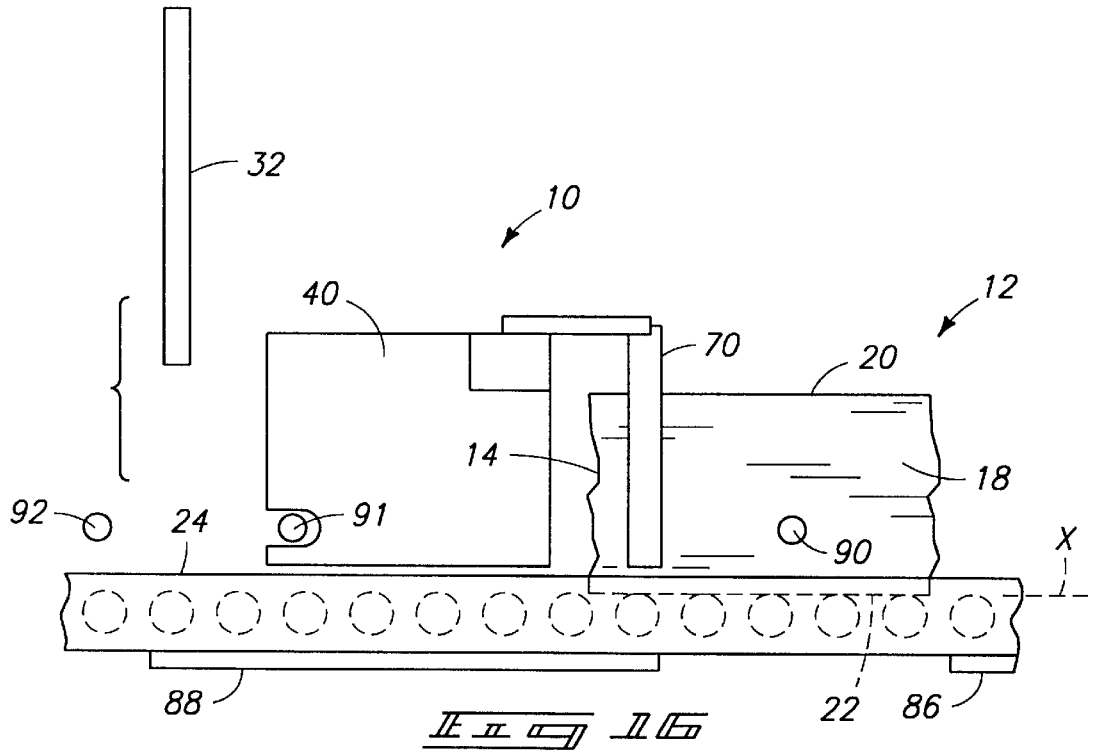
Figure 17:
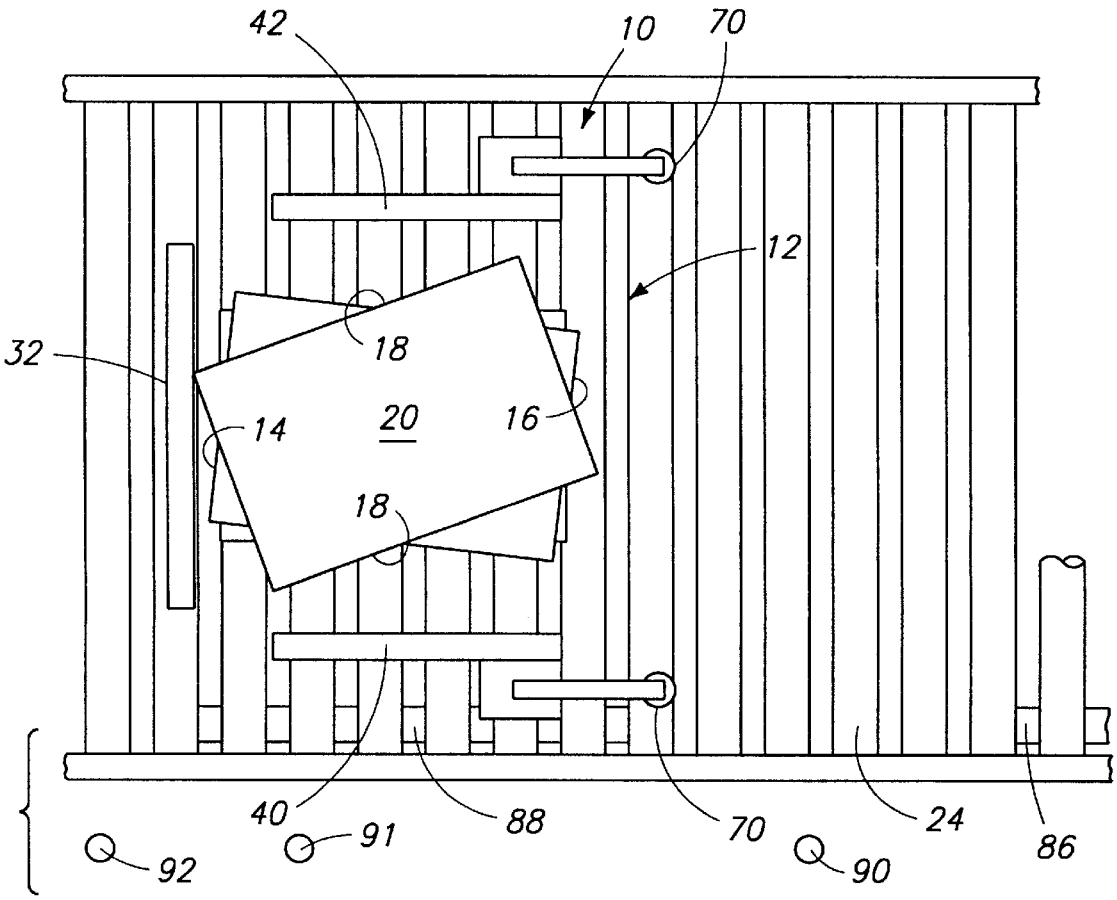
Figure 18:
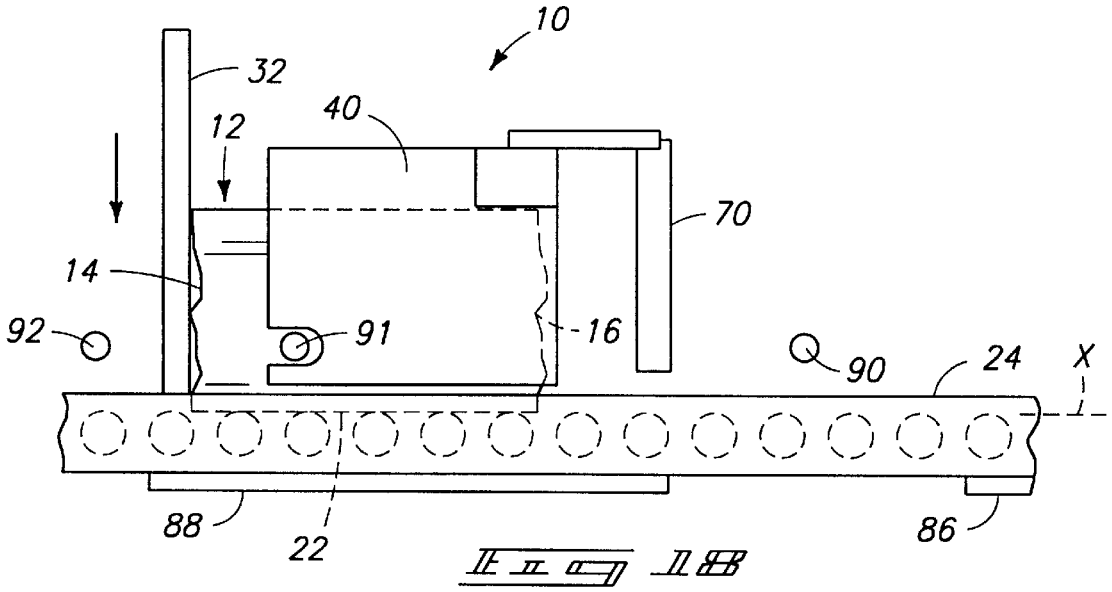
Figure 19:
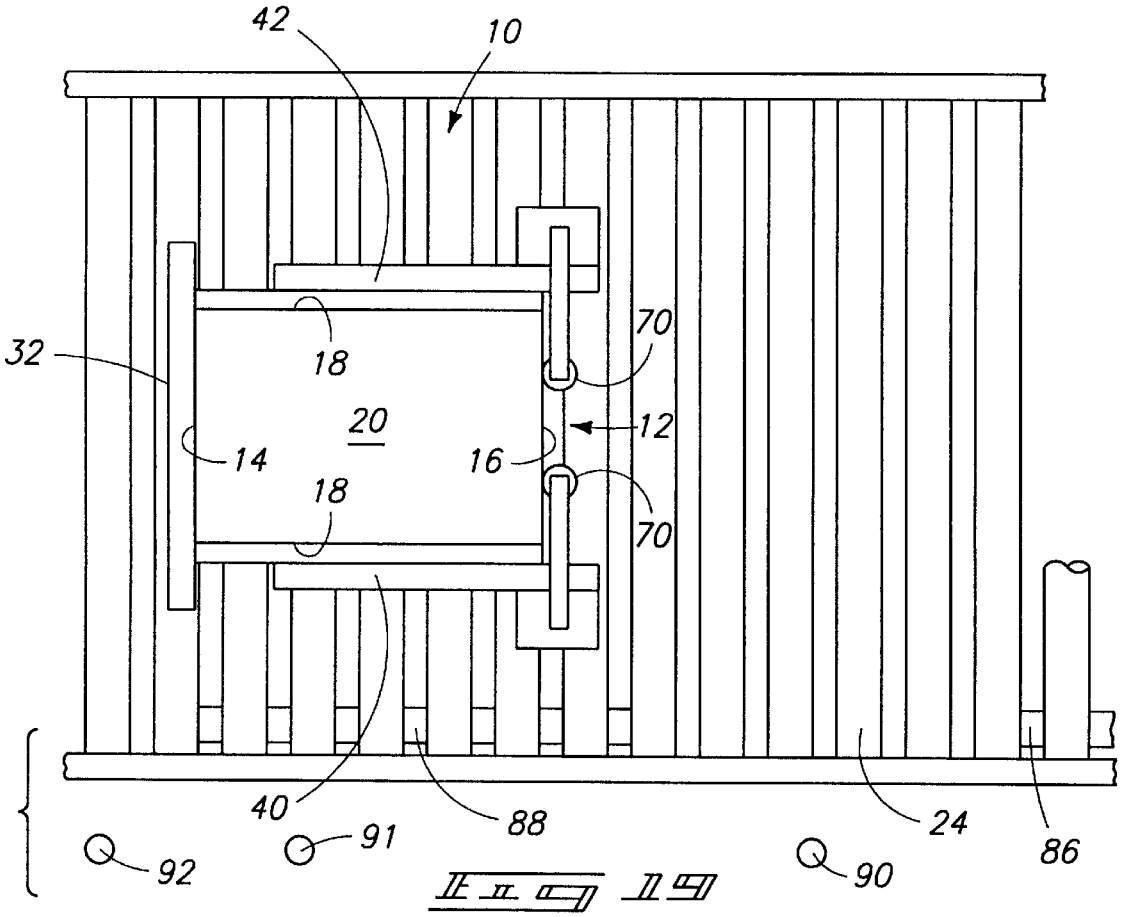
Figure 20:
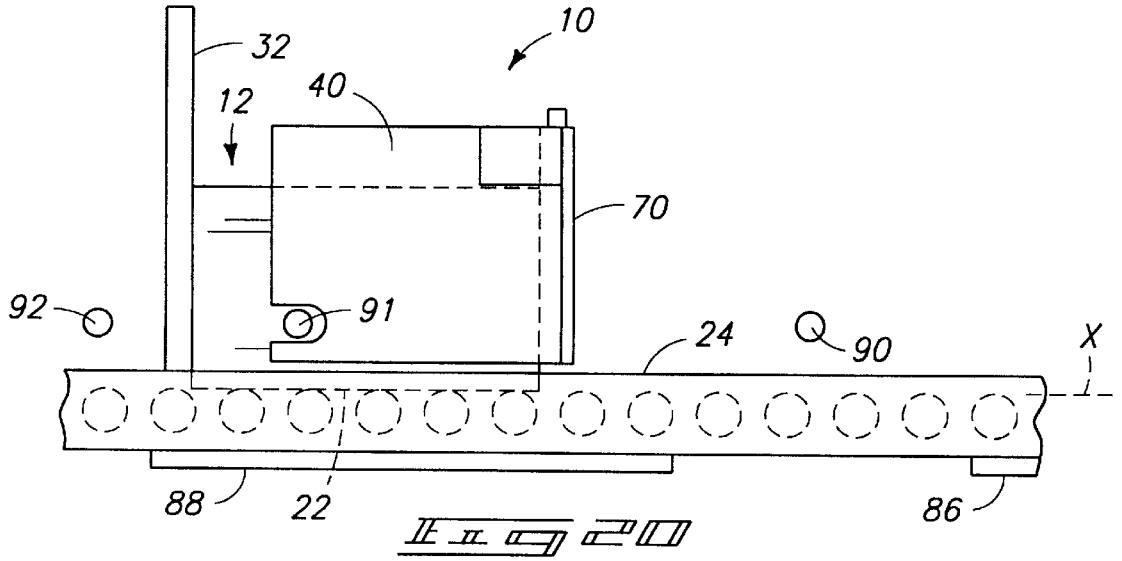

In FIG. 3, a series of photo eyes are shown positioned along side the conveyor 24 for detecting the presence and location of successive bundles delivered along the conveyor. A "bundle coming" photo eye 90 is adjustably situated upstream of the trailing end tampers. A "bundle present" photo eye 91 is positioned just forward of the plane of the leading end bundle stop 32. A "bundle clear" photo eye 92 is situated slightly downstream of the stop 32. For further control, a bundle stop "up" limit switch 94 is positioned on the frame to be actuated when the bundle stop 32 is lifted. The above control elements, along with a sequencer 96, and a cycle duration timer 97 are used in a control circuit 100 (FIG. 14) to provide automatic operation of the present machine.

The preferred present machine 10 is installed along an existing bundle conveyor 24. Alternatively, the machine 10 may be produced with an integral length of infeed conveyor 24 positioned to receive bundles from an appropriate source. Assuming the present machine 10 is to be installed along a pre-existing conveyor, the frame 28 is installed with the frame legs 29 straddling the conveyor, and the hat section 31 is oriented transversely to and spanning the conveyor working flight. Appropriate adjustments may now be made to situate the leading end stop 32, the side plates 40, 42, and the trailing end actuators in close working relationship to the top, working surface (plane X) of the bundle conveyor.

It is preferable to install conventional, known forms of roller conveyor brakes 84, 86, 88 at three locations along the conveyor 24 (FIG. 3). The brakes may be supplied with the machine and may be mounted to an existing conveyor frame below the powered conveyor rollers. If the present machine 10 is manufactured with a conveyor 24, the brakes will be installed before shipment. In either instance, the spaced brakes are useful in the operational sequence to enable delivery of a succession of single bundles for squaring.

One conveyor brake 84 is situated preferably about 10 feet upstream of the leading bundle end stop 32. The next brake 86 is situated approximately 5 feet upstream (5 feet downstream of the brake 84). The third brake 88 is centered along the conveyor below the hat section 31 and just upstream of the stop 32.

In initial set-up of the present machine, the various adjustment features are utilized to adapt the machine to a particular bundle size. For example, a bundle or a sample sheet from a bundle to be squared is placed in the machine below the hat section 31 on the conveyor 24 with the leading end engaging the stop 32.

The side plates 40, 42 may also be adjusted using the side plate carriage adjustments by selectively sliding the carriages 51, 52 along the belt 44 to desired locations, then clamping the carriage to the upper and lower flights of belt 44. This adjustment determines the lateral position of bundles leaving the squaring mechanism.

The bundle width (between bundle sides 18) may be accommodated by use of the adjustment carriage 49. The lock screw 62 is loosened to allow the cylinder 48 and side plate carriages 51, 52 to be shifted along the frame hat section 31. This is best done with the cylinder 48 fully extended. One of the side plate carriages is pushed laterally until the associated side plate engages the side of the sample sheet. The remaining side plate carriage and side plate will automatically move to engage the opposite side of the sample sheet (due to interconnection of the side plate carriages to the opposed flights of belt 44). Once the sample sheet side edges are firmly gripped between the side plates, the lock screw is re-tightened.

The side plates will now move only through a distance determined by the stroke length of the cylinder 48. As the cylinder extends to its full stroke, the side plates 40, 42 will move together uniformly until they are separated by the width of the sheet. As the cylinder 48 retracts, the side plates 40, 42 will spread apart equally to opposite sides of the sheet.

The distance between the trailing end tampers 72, 73 and the leading bundle end stop 32 may be adjusted using the adjustment guides 80, 81 to position the tampers in firm engagement with the sample sheet trailing end at the full inward swing positions of the tamper arms.

Process and Operation

The preferred process includes the following steps, preferably occurring in the following order. Reference is made to FIGS. 15–22 and to the control schematic of FIG. 14.

First, the leading end stop 32 is moved to engage the leading end of a bundle fed into the machine along conveyor 24 (FIGS. 15–18). This is done by activating the stop actuator 33 to extend, lowering the stop 32 to its full down position. It is noted that the bundle 12 may be in disarray, with the side and end edges of the sheets misaligned.

As a next step, the trailing end tampers are pivoted to engage the trailing end 16 of the bundle and urge the bundle forwardly against the leading end stop 32. The weighted tamper arms strike the trailing bundle end, driving them forwardly and aligning the sheets along the leading and trailing ends of the bundle. The leading and trailing ends of the bundle are now squared.

Next, the side plates 40, 42 are moved together by actuation of the cylinder 48 to extend. The side plates initially engage the bundle at the bottom 22, then tip to upright positions (see FIGS. 11, 12 and 21), progressively aligning the side edges of the sheets from the bundle bottom 22 to the bundle top 20. The side plates also function to slide the bundle to a selected lateral position on the conveyor while performing the side squaring function. The bundle is now perfectly squared and positioned where desired on the conveyor for release. Release (FIG. 22) is accomplished simply by raising the leading bundle end stop 32 (by retracting the stop actuator 33).

The above operation is automatically controlled following set up, so that every successive bundle delivered along the conveyor is squared and discharged from the present machine at a selected position on conveyor 24. The following explanation is given of the operational control and sequencing with the assumption that bundles are traveling along the bundle conveyor at regular intervals.

As a bundle approaches the machine, its presence is detected by the "bundle coming" photo eye 90. In response, the sequencer 96 shifts to step one, at which the upstream conveyor brakes 84, 86 are set, halting further forward progress of the bundle upstream, as the detected bundle moves on ahead into the squaring machine. The first two conveyor brakes 84, 86 are energized via appropriate output relays to allow only the bundle detected by the "bundle coming" photo eye 90 to move into the machine.

The bundle travels into the machine until its leading end 14 contacts the leading end stop 32 (which is in its down position), and blocks the "bundle present" photo eye 91. In response the sequencer 96 is shifted to step two. The sequencer 96 activates the rotary actuators to swing the tamper arms inwardly against the trailing bundle end, squaring the bundle leading and trailing ends. Now the third brake 86 is set. In very short succession, and in the same step, the side plate actuator is operated to shift the side plates 40, 42 inwardly to engage and square the bundle sides 18. As the side plates move together, the trailing end tampers (which also move inwardly with the side plates) slide or roll over the trailing bundle end, assisting the squaring action of the side plates.

At this point, the cycle duration timer 97 reaches a preset value and the sequencer shifts to step three. In response, the leading bundle end stop 32 is lifted, followed in sequence by the remaining squaring components (the tamper arms and side plates) which also return to their starting, open positions.

Once the leading bundle end stop 32 clears the bundle top 20, the bundle stop limit switch 94 is operated, shifting the sequencer to step four. At this time all the brakes 84, 86, and 88 are released and the conveyor is allowed to shift the squared bundle from the machine and advance the successive bundles forwardly.

The squared bundle passes the downstream bundle clear photo eye 92, which shifts the sequencer 96 to reset to zero. At this time the bundle stop actuator 33 is activated to lower the bundle leading end stop 32. The cycle will now repeat for each subsequent bundle.

It is noted that the above complete operational sequence may be performed in about 3 seconds. This rate of operational speed is similar to or greater than that of the upstream finishing equipment, so production is not slowed. In fact the present machine and process may indeed speed production since the bundles are precisely squared automatically, freeing the workers' time to attend to pallet loading or stack forming downstream of the present machine.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. A machine for squaring semi-rigid sheets stacked in a bundle supported along a plane and having a leading bundle end, a trailing bundle end and opposed bundle sides, comprising:

a frame;

a leading end stop;

a stop actuator mounting the leading end stop to the frame and operable to position the leading end stop across the plane to engage the leading end of the bundle;

a pair of side plates;

a side plate actuator assembly mounting at least one of the side plates to the frame for movement toward and away from the other one of the side plates to (a) engage and align sheets along the bundle sides and (b) position the bundle at a prescribed position on the plane;

a trailing end tamper; and a trailing end actuator mounting the trailing end tamper to one of the side plates for movement to engage and urge the bundle against the leading end stop and align the sheets along the leading and trailing ends of the bundle.

2. The machine of claim 1, wherein the leading end stop and leading end stop actuator are mounted to the frame for adjustment toward and away from the side plates.

3. The machine of claim 1, wherein at least one side plate is mounted to the side plate actuator assembly for independent adjustment toward and away from the other side plate.

4. The machine of claim 1, wherein both side plates are mounted to the side plate actuator assembly and are movable relative to the frame for independent adjustment toward and away from one another.

5. The machine of claim 1, wherein the pair of side plates are mounted to the side plate actuator by an angle controller, which yieldably positions the side plates at angles converging toward the plane so the side plates will initially engage the bundle at a bottom surface thereof, then shift to substantially parallel positions normal to the plane in response to operation of the side plate actuator.

6. The machine of claim 1, wherein the trailing end tamper is comprised of a tamper arm mounted to the trailing end actuator substantially normal to the plane.

7. The machine of claim 1, wherein the trailing end tamper is comprised of a weighted tamper arm pivotably mounted by the trailing end actuator for pivotal movement about a tamper arm axis that is substantially normal to the plane.

8. A machine for squaring a bundle of semi-rigid sheets, the bundle having bundle sides, leading and trailing ends, comprising:

a frame;

a conveyor on the frame with a working flight configured to support and move the bundle, leading end first from a conveyor infeed end to a conveyor discharge end;

a leading end stop;

a stop actuator mounting the leading end stop to the frame and operable to position the leading end stop across the conveyor to stop the bundle on the conveyor and engage and align sheets along the leading end of the bundle;

a trailing end tamper;

a pair of side plates a trailing end actuator mounting the trailing end tamper to one of the side plates for movement to engage and urge the bundle against the leading end stop and align the sheets along the trailing end of the bundle; and a side plate actuator assembly mounting the side plates to the frame for lateral movement in relation to the conveyor to (a) engage and align sheets along the bundle sides and (b) position the bundle at a prescribed lateral position on the conveyor.

9. The machine of claim 8, wherein the trailing end tamper and trailing end actuator are mounted to the side plate actuator assembly for movement with the side plates.

10. The machine of claim 8, wherein the pair of side plates are mounted to the side plate actuator by an angle controller, which yieldably positions the side plates at angles converging toward the plane so the side plates will initially engage the bundle at a bottom surface thereof, then shift to substantially parallel positions normal to the conveyor working flight in response to operation of the side plate actuator.

11. The machine of claim 8, wherein the trailing end tamper is comprised of a tamper arm mounted to the side plate actuator assembly substantially normal to the conveyor working flight.

12. The machine of claim 8, wherein the trailing end tamper is comprised of a weighted tamper arm operably mounted to the side plate actuator assembly for pivotal movement about a tamper arm axis that is substantially normal to the conveyor working flight.

13. The machine of claim 8, further comprising brakes on the conveyor selectively operable to stop the conveyor subsequent to operation of the stop actuator to position the leading end stop across the conveyor.

14. A process for squaring stacked semi-rigid sheets in a bundle having a leading end, a trailing end, opposed sides, a top surface and a bottom surface supported along a plane, comprising an ordered succession of steps including:

first moving a leading end stop to engage the leading end of the bundle;

secondly, moving a trailing end tamper to engage and urge the bundle against the leading end stop and align the sheets along the leading and trailing ends of the bundle; and thirdly, moving at least one side plate of a pair of opposed side plates toward the other side plate of the pair to (a) engage and align sheets along the opposed bundle sides and (b) position the bundle at a prescribed position on the plane.

15. The process of claim 14, wherein the step of moving the trailing end tamper is accomplished by:

swinging a weighted tamper arm about a tamper arm axis that is substantially normal to the plane; and moving the tamper arm axis with said at least one side plate.

16. The process of claim 14, wherein the step of moving the trailing end tamper is combined with the step of moving the pair of opposed side plates such that the trailing end tamper moves with said at least one side plate.

17. The process of claim 14, comprising the further step of angularly moving the pair of side plates from initial angles converging toward the plane to substantially parallel positions normal to the plane.

18. The process of claim 14, wherein the step of moving the trailing end tamper is accomplished by swinging a weighted tamper arm about a tamper arm axis that is substantially normal to the plane.

19. The process of claim 14, wherein the step of moving the trailing end tamper is accomplished by swinging a pair of weighted tamper arms against the trailing end of the bundle about parallel tamper arm axes that are substantially normal to the plane.

* * * * *